219-121
9/7/82 XR 4,348,263

United States Patent [19]

Draper et al.

[11] 4,348,263

[45] Sep. 7, 1982

[54] SURFACE MELTING OF A SUBSTRATE PRIOR TO PLATING

[75] Inventors: Clifton W. Draper, Hopewell, N.J.; Satya P. Sharma, Reynoldsburg, Ohio

[73] Assignees: Western Electric Company, Inc., New York, N.Y.; Bell Telephone Laboratories, Incorporated, Murray Hill, N.J.

[21] Appl. No.: 186,654

[22] Filed: Sep. 12, 1980

[51] Int. Cl.[3] ..... C25D 5/34; H01H 1/02

[52] U.S. Cl. ..... 204/29; 200/267; 204/37 R; 204/192 C; 219/121 EG; 219/121 LF; 219/121 LM; 339/278 C; 427/35; 427/53.1; 427/319; 427/250

[58] Field of Search ..... 204/29, 192 C; 219/121 EF, 121 EG, 121 LE, 121 LF; 427/35, 53.1, 318, 319; 200/262, 267; 339/278 C

[56] References Cited

U.S. PATENT DOCUMENTS

| | | | |
|---|---|---|---|
| 3,848,104 | 11/1974 | Locke | 219/121 L |
| 3,952,180 | 4/1976 | Gnanamuthu | 219/121 LM |
| 4,015,100 | 3/1977 | Gnanamuthu | 219/121 LM |
| 4,122,240 | 10/1978 | Banas et al. | 428/655 |
| 4,153,523 | 5/1979 | Koontz et al. | 240/129.6 |
| 4,157,923 | 6/1979 | Yen et al. | 148/4 |
| 4,281,030 | 7/1981 | Silfvast | 427/42 |

OTHER PUBLICATIONS

E. M. Breinan et al., "Laser Glazing . . . ", Society Of Manufacturing Engineers, Technical Paper MR 76-867.

A. K. Graham, *Electroplating Engineering Handbook*, 2nd Ed., Reinhold Publishing Co., New York, 1962, pp. 65-67.

Flowenheim, *Electroplating*, McGraw-Hill Book Co., New York, 1978, pp. 57-60.

T. R. Anthony et al., "Surface Rippling . . . ", Journal Of Applied Physics, vol. 48, pp. 3888-3894 (1977).

E. M. Breinan et al., "Processing Materials With Lasers", *Physics Today*, Nov. 1976, pp. 44-50.

T. R. Anthony et al., "Surface Normalization . . . ", *Journal Of Applied Physics*, vol. 49, No. 3, pp. 1248-1255 (1978).

J. M. Walsh et al., "Suppression Of . . . ", *Proceedings, Thirty-Fifth Annual EMSA Meeting*, vol. 35, pp. 270-271 (1977).

S. C. Hsu et al., "Rapid Melting . . . ", *Metallurgical Transactions B*, vol. 98, pp. 221-229 (1978).

F. Haessner et al., "Laser-Induced Dislocation . . . ", *Journal Of Materials Science 6*, pp. 16-18 (1971).

L. Buene et al., "Laser Irradiation . . . ", *Applied Physics Letters*, vol. 37, pp. 385-387 (Aug. 15, 1980).

J. K. Hirvonen et al., "Pulsed Electron Beam . . . ", *Applied Physics Letters*, vol. 36, pp. 564-566 (Apr. 1, 1980).

*Primary Examiner*—Delbert E. Gantz
*Assistant Examiner*—William Leader
*Attorney, Agent, or Firm*—James H. Fox; Peter V. D. Wilde

[57] ABSTRACT

Substrates for use in electrical contacts are prepared prior to plating by rapid surface melting by means of a laser beam or an electron beam. Improved microscopic surface characteristics are obtained. In a preferred embodiment, improved macroscopic surface roughness characteristics are also obtained by shorter-duration melting, typically by means of a pulsed YAG laser. Gold which has been electroplated onto copper alloys prepared by this technique has shown improved resistance to sulfur and chlorine corrosive atmospheres. This allows, for example, a thinner layer of a protective metal to be used to obtain a given degree of protection.

15 Claims, No Drawings

SURFACE MELTING OF A SUBSTRATE PRIOR TO PLATING

BACKGROUND OF THE INVENTION

1. Field of the Invention

This invention relates to making an electrical contact by treating a metallic substrate prior to depositing a protective layer thereon.

2. Description of the Prior Art

The deposition of a metal onto a metallic substrate, typically accomplished by electroplating from an electrolytic solution, is used in a variety of industries for a variety of purposes. For electrical and electronic components such as switch contacts, relay contacts, printed circuit board contacts, integrated circuit contacts, etc., a layer of a protective metal is deposited onto a substrate metal. The protective metal typically reduces corrosion of the substrate material. This helps maintain low electrical resistance to the substrate material, which is important for electrical contacts. The protective metal is typically a precious metal, such as gold, silver, platinum, etc., and the substrate metal is typically nickel, copper, etc., and alloys thereof.

In order to prepare the substrate for the subsequent metal deposition, it is desirable to minimize surface inhomogeneities on the substrate. This is often accomplished by chemical or electrochemical polishing of the substrate prior to electroplating. With the recent advent of continuous strip processing of electrical connectors, both the electropolishing and electroplating steps are typically accomplished in one continuous operation; see, for example, U.S. Pat. No. 4,153,523, assigned to the same assignee as the present invention. Other methods of preparing substrates include flame melting, wherein gross surface inhomogeneities are reduced in magnitude. Mechanical polishing or grinding steps may also be taken to prepare substrates for plating.

With the increased cost of certain plated metals, including gold, it has become especially desirable to find ways or reducing the amounts of such plated metal necessary to protect the substrate. Therefore, it is desirable to find improved methods of preparing substrates prior to depositing a protective layer thereon, in order to reduce the amount of protective metal required. To be compatible with a continuous high-speed strip plating process, as that noted above, any substrate preparation technique should be capable of sequential, high-speed treatment of substrates. Furthermore, with the trend toward selective plating in order to conserve precious metals, any treatment desirably is capable of treating selected areas of substrates.

SUMMARY OF THE INVENTION

We have invented a method of making an electrical contact by treating a metallic substrate prior to depositing a protective layer thereon. This method comprises rapid surface melting of the substrate by means of radiant energy. The rapid melting, typically less than 10 milliseconds in duration, melts a thin layer of the substrate surface. Following this treatment, a protective layer is deposited on the substrate by any of various prior art techniques, including electroplating. The source of the radiant energy used for melting is an electron beam or laser beam. In a preferred embodiment, the melt duration is less than 5 microseconds, typically obtained by means of a pulsed radiation beam.

DETAILED DESCRIPTION

In the design of electrical contacts, it is frequently necessary to provide for a protective layer of a relatively inert metal on a substrate metal in order to protect the substrate from corrosive environments that would increase contact resistance. A typical design rule is to maintain the contact resistance to within about 10 times the initial value over the operating life of the contact. For example, the initial resistance of a contact, operating with a contact force of 1 Newton, is typically about 3 to 5 milliohms. Thus, the maximum design resistance over the life of the contact should be less than 1 ohm and typically less than 100 milliohms. The protective metal is typically substantially nonoxidizing at the expected operating temperature, although a thin conductive oxide layer may be present with certain of the protective metals. It has been found that in many environments, the main corrosive substances comprise chlorine or sulphur, causing an increase in the contact resistance of unprotected nickel or copper alloy substrates.

As used herein, the term "electrical contact" refers to an electrically conductive metallic member intended to complete a portion of an electrical circuit when the member is brought into physical contact with another conductive member. One or both of such members can be made according to the inventive method. At least the electrical contact made according to the inventive method comprises a substrate metal and a protective conducting layer deposited on at least a portion of the substrate. In the case of switch contacts, relay contacts, etc., two or more electrical contacts are assembled in proximity so as to be able to be brought into physical contact upon actuation of the switch, relay, etc. In the case of printed circuit board contacts, integrated circuit contacts, etc., the electrical contacts are brought into physical contact upon insertion of the printed circuit board or integrated circuit into a socket or other receptacle.

We have found that if a surface layer of a substrate metal, typically comprising a base metal such as nickel, copper alloy, etc., is rapidly melted prior to plating a protective metal thereon, the incidence of corrosion of the substrate metal is substantially reduced. The rapid melting results in high quench rates as the metal refreezes, being greater than $10^5$ degrees C. per second. While quench rates and melt times will vary with the substrate material, the relevant melt times included herein are less than 10 milliseconds, and the melt depths less than 0.1 millimeters, which distinguishes the present invention from various prior art melting processes prior to plating. In addition, only a surface layer is melted and not the entire substrate. This rapid melting produces improved microscopic surface smoothness and reduced grain size of the substrate, which improves the ability of the protective metal deposited thereon to protect the substrate from corrosion. Rapid surface melting has previously been employed in certain situations to improve various characteristics of metals, such as hardness, homogeneity, corrosion resistance, etc.; see, e.g., U.S. Pat. No. 4,122,240. However, in the present case, it is the improved characteristics of the deposited layer, rather than the characteristics of the melted layer per se, that are of primary significance in improving the corrosion resistance of the substrate.

In a first embodiment, a continuous wave (CW) energy source, such as a $CO_2$ laser or electron beam, is moved across the surface of the substrate in order to produce melting. In a preferred embodiment, a pulsed radiation beam, typically a Q-switched neodymium yttrium aluminum garnet (YAG) laser, is used. In addition to improved microscopic homogeneity and smoothness, the pulsed radiation technique improves the macroscopic surface smoothness as compared to a typical continuous wave radiation. As used herein, the terms "pulsed radiation" and "pulsed laser" refer to radiant energy sources that produced discrete energy pulses in the time domain. These terms are not descriptive of, or limiting to, the method of achieving such energy pulses. For example, "pulsed laser" includes capacitor-switched lasers, Q-switched lasers, etc. Further, as used herein, "microscopic" refers to surface features having dimensions of less than 10 micrometers, and "macroscopic" refers to surface features having dimensions of greater than 10 micrometers and typically on the order of the diameter of the radiation beam used for melting.

The depth of melting will depend upon the substrate material and the power and duration of the radiation beam. For example, with nickel substrate material, a melt time of 10 milliseconds typically provides for a maximum melt depth of 0.1 millimeters, while a melt time of 5 microseconds provides for a maximum melt depth of approximately 2.5 micrometers. For a given melt time, the melt depth is limited to these maximum values due to the fact that higher power densities result in vaporization of the substrate material. A theoretical computer heat flow model which relates melt depths to melt times and heat fluxes, such as obtained via continuous $CO_2$ laser radiation, is given in "Rapid Melting And Solidification Of A Surface Layer", by S. C. Hsu et al, in *Metallurgical Transactions B,* Vol. 9B, pages 221–229, June 1978.

It is known that the various modes of tarnish failure possible for an electrical contact system in severe environments are: (1) diffusion of substrate metal through grain boundaries of the protective metal layer, and the subsequent reaction of the substrate metal with the environment; (2) porosity in the protective metal layer, resulting in electrochemical corrosion of the substrate metal through the pores; (3) wear processes which expose the substrate metal, and the environmental reaction with the exposed metal, causing the tarnished products to accumulate in the contact region. Any or all of these may increase the contact resistance.

All or some of the above failure modes may be operative in a particular contact system. It has been found that the above-noted surface-melting processes prior to depositing a protective metal layer are effective in reducing corrosion in chlorine and sulfur environments. This is due at least in part to the improvement in the microscopic surface characteristics of the substrate, due in part to a reduction in grain size. It has been found that this results in smaller grain size of the protective metal layer and less diffusion of the base substrate metal through the protective layer, according to (1) above. Prior to melting, the substrate has metal grain diameters of at least 500 Angstroms (50 nanometers) and typically on the order of 1 micrometer. After surface melting, the grain diameters are less than 500 Angstroms. In some cases, the melted surface may be amorphous; i.e., no grains at all. The above-noted principles will be more fully illustrated by the means of the following Examples:

EXAMPLE 1

The radiation source in this Example is a $CO_2$ continuous wave laser operating at 10.6 micrometers, having an output power of 1200 watts and a beam diameter of 1.9 centimeters. This beam was focused with a zinc selenide lens to a spot having a diameter of approximately 125 micrometers. To protect the focusing lens from vaporization products, to minimize plasma formation above the molten surface, and to reduce oxidation of the molten metal, inert gas, typically argon at 10 lbs. per square inch, was blown across the lens and through a nozzle onto the metal surface. The laser beam was stationary, and the sample was moved transversely to the beam at a given velocity by means of a wheel configuration in order to achieve large area coverage. The laser-melted stripes were overlapped by approximately 50 percent or more in order to provide good surface coverage. The substrate material tested was CDA 725, which is 89 percent copper, 9 percent nickel, 2 percent tin. The coupon was cleaned with detergent, and one-half of the coupon was plated in a standard hard gold cyanide bath with 0.5 micrometer thick gold. A first coupon prepared in this manner was exposed to 5 parts per million $H_2S$ at 80 percent relative humidity for 48 hours. A second similarly prepared coupon was exposed to 1.8 parts per million $Cl_2$ at 80 percent relative humidity for 4 days. Auger depth profiles were used to determine the thickness and composition of the films that grew on both the melted and unmelted regions. The corrosion film thickness on the first coupon was approximately 69 Angstroms on the unmelted gold-plated portion, and approximately 48 Angstroms on the laser-melted gold-plated portion. Thus, the corrosion was reduced by 30 percent in the laser-melted portion, as compared to the unmelted portion. On the second coupon, the corrosion film thickness on the unmelted gold-plated portion was approximately 7600 Angstroms, while on the laser-melted gold-plated portion, the corrosion film thickness was approximately 5200 Angstroms. Thus, a reduction of corrosion film thickness of approximately 32 percent was achieved on the second coupon by the use of the laser melting prior to plating.

The translation velocity of the above coupons beneath the laser beam was approximately 60 centimeters per second. With the beam diameter noted above, this implies a melt time at each point on the coupon of approximately 0.2 milliseconds, neglecting the partial overlap of adjacent stripes. This relatively slow translation velocity has been found to produce relatively high amounts of surface roughness. For example, at 60 centimeters per second, an average roughness height of about 2.5 micrometers is obtained by surface stylus measurements, as compared to less than about 0.12 micrometers for the 400 grit randon finish. The roughness of the laser-melted sample had a period approximately equal to the width of the partially overlapped melt stripes and hence was "macroscopic". Due to this surface roughness, the laser-glazed portion of the coupon appeared dull by visual inspection as compared to the unglazed portion. However, the topography of the laser-glazed region on a microscopic scale was much smoother than for the unglazed region. It is the improvement in the microscopic surface characteristics which provides for the superior gold-plating corrosion results noted above.

For certan applications, a certain amount of macroscopic roughness is tolerable. For example, if it is desired to protect an electrical contact simply from atmospheric corrosion-causing products, a rough surface can be adequate. However, if the contact is subject to substantial mechanical wear, such as with a switch contact, relay contact, etc., it is desirable to minimize the macroscopic roughness as well. This is because mechanical wear on a macroscopically rough surface will tend to degrade any plated metal on the rough surface, as the wear will be uneven. This can erode a portion of the plated material, exposing the substrate material and accelerating the corrosion process, according to (3) above. In addition, if the macroscopic surface characteristics are improved, it has been found that the porosity of the protective layer is typically improved, resulting in reduced corrosion, according to (2) above.

One way of reducing the height of macroscopic surface roughness when a continuous wave radiation source is used is to increase the translation velocity of the substrate material with relation to the radiation beam. For example, when a CDA 725 coupon is surface melted at a radial velocity of 150 centimeters per second, a surface roughness height of only about 0.5 micrometers is obtained. Therefore, by processing samples at high velocities, typically greater than 150 centimeters per second, the surface roughness can be reduced substantially; see also ¢Surface Rippling Induced By Surface-Tension Gradients During Laser Surface Melting And Alloying", T. R. Anthony et al, *Journal Of Applied Physics,* Vol. 48, pages 3888–3894 (1977).

As the velocity increases, the melt depth and width will reduce. For certain materials, it may be necessary to have a large melt depth. Successive scans from a lower to higher velocity may be performed for these materials. The higher velocity will reduce the surface roughness which occurs at lower velocities; that is, greater dwell time and therefore deeper melts. The final velocity can be chosen so that the surface roughness is minimum. Rather than translating the substrate, the laser beam may be translated across the surface of the substrate, as by scanning mirrors. The surface smoothness can also be improved by dithering the laser beam while scanning; see U.S. Pat. No. 3,848,104 for typical apparatus. All such procedures of translating the substrate and radiation beam transversely relative to each other are included herein.

It has been further discovered that shorter duration melting, resulting in smaller melt depths, produces improved macroscopic surface roughness as compared to longer melting. The shorter melt times are typically produced by means of a pulsed radiation source. The melt time per radiation pulse is typically less than 5 microseconds and preferably less than 1 microsecond, resulting in melt depths of typically less than 5 micrometers and 1 micrometer, respectively. Under these conditions, a macroscopic surface roughness is typically obtained which is at least as smooth as a 400 grit random finish. The use of a pulsed YAG laser to achieve melting will be more fully illustrated by means of the following Example:

EXAMPLE 2

The radiation source used in this Example is a Q-switched neodymium YAG laser, with an average-power output of 1.4 watts at a wavelength of 1.06 micrometers. The pulse repetition rate is approximately 11 kilohertz, and the pulse duration is approximately 130 nanoseconds. The laser beam was focused to a spot size of approximately 40 microns by means of a telecentric lens. This allowed scanning the beam over a large area while maintaining focus of the beam. A coupon of CDA 510, which is a phosphorbronze alloy (approximately 95.4 percent copper, 4.4 percent tin, 0.1 percent zinc, and 0.1 percent phosphorus), was surface melted by overlapping the laser melted stripes by approximately 30 percent until a large area was covered. It is estimated that the melt time per laser pulse at each point on the coupon was approximately 0.5 microseconds. Due to the brief melt time, it was not necessary to use a protective inert atmosphere to prevent oxidation of the substrate, and melting was accomplished in a normal air atmosphere. The surface obtained had a mirror finish by visual inspection, showing that macroscopic roughness was greatly reduced as compared with the prior Example. This is due to a much shallower melt depth, which is possible in part due to increased absorbence of copper alloys at shorter wavelengths, typically less than 1.1 micrometers, as compared with the above Example. The microscopic characteristics were also improved, as the shorter melt time resulted in a higher quench rate, which produces smaller metallic grains than the prior Example. Thus, both increased corrosion resistance to substances in the environment and increased wear resistance is obtained for a protective layer deposited on this substrate.

EXAMPLE 3

The radiation source used for melting in this Example is a frequency-doubled Q-switched neodymium YAG laser operated at a wavelength of approximately 0.53 micrometers. The pulse duration is approximately 140 nanoseconds, and the pulse repetition rate is approximately 5 kilohertz. The laser beam was focused to a spot size of approximately 34 micrometers. The average power in the frequency-doubled beam was approximately 230 milliwatts. To melt a large area of a CDA 510 coupon, the coupon was translated on an X–Y table between laser pulses so that the individual laser melt spots were overlapped approximately 30 percent, as above. In this manner, a large area of the coupon was laser melted in a normal air atmosphere. It is estimated that the melt time per laser pulse was approximately 0.5 microseconds. It was observed that not only did the surface achieve a visual mirror finish, but microscopic defects were further reduced as compared to the above Example 2. This apparently is due to the fact that at the shorter wavelength of 0.53 micrometers, the reflectivity of the CDA 510 coupon is less than for the 1.06 micrometer radiation of the above Example. As the defect centers tend to have anomalously high coupling coefficients to the radiation, in the case of the 1.06 micrometer radiation, the coupling centers will absorb a relatively higher amount of energy than the rest of the surface. Thus, the defect centers will be enlarged. However, in the case of the radiation at wavelengths of typically less than about 0.6 micrometers, the defect centers absorb relatively less power as compared to the rest of the surface, and thus the growth of the defects is not enhanced as much as before. Therefore, this final Example has still improved characteristics with respect to serving as a substrate for subsequent deposition operations.

While the above Examples serve as typical representations of present-day laser heating techniques suitable for practicing the invention, other heating sources may be used. For example, surface melting by means of an electron beam is another presently available technique. The electron beam has the advantage of being more readily absorbed by typical substrate metals, and hence considerations of surface reflectivity such as those noted above are not as significant. Furthermore, electron beams may be pulsed at high repetition rates and may have high energy density, etc. On the other hand, lasers are the presently preferred source, as they typically do not require placing the substrate material in a vacuum during melting. While a radiation beam that is small compared to the total melt area can be used, as above, a beam that is comparable in size to the total melt area can alternately be used.

Although gold has been used as an illustrative protective metal in the above Examples, other protective metals can also be used. In particular, silver, platinum, ruthenium, rhodium, iridium, and palladium, and alloys thereof, are relatively expensive protective metals, which can advantageously be deposited on substrates prepared by the present technique. This will typically allow thinner amounts of these metals to achieve a given degree of corrosion protection. It is also possible that the protective layer is in the form of a conductive metallic oxide or other metallic compound. For example, ruthenium dioxide ($RuO_2$) is presently being considered as a protective layer for a number of contact applications. In that case, ruthenium metal can be deposited on the substrate and then oxidized to form $RuO_2$. Alternately, a ruthenium compound, typically $RuCl_3$, can be deposited on the substrate and then oxidized to form the $RuO_2$ layer. If the deposition is accomplished by electrochemical deposition, sputtering, or evaporation, it is expected that the present inventive substrate preparation technique will improve the corrosion resistance of the resulting $RuO_2$-protected substrate. Similar considerations apply to other conductive metallic compounds. Based on the foregoing results, it is believed that the protective layer can typically be at least 20 percent thinner with the inventive treatment to achieve a given degree of substrate protection from the corrosive effects of sulphur or chlorine-containing environments.

Various substrate materials can be treated by the present technique. It has been found typically necessary to choose substrate materials that have a thermal conductivity of less than 1 watt/cm-degree K at just below the melting temperature to ensure rapid melting to a shallow depth. Otherwise, the substrate conducts the heat energy away so rapidly that a thin melt depth, and high quench rates are not obtained. For this reason, if copper is employed as a substrate material, it is desirably in the form of an alloy having a lower thermal conductivity than pure copper. However, for use as an electrical contact, the percentage of copper in an alloy is typically greater than 80 percent to ensure good electrical conductivity. Note also that the substrate metal that is melted may itself have been plated or otherwise deposited on an underlying substrate. For example, nickel plated on copper forms a common substrate material, with the melting herein typically being limited to the topmost layer, which is nickel in this case.

While the present technique is advantageously used preceding an electroplating operation, other metal deposition techniques can advantageously use the inventive substrate preparation technique. For example, the metal may be deposited upon the substrate by means of plasma deposition, sputtering, evaporation, electroless plating, etc. In addition, conventional substrate preparation techniques may be used in conjunction with the present technique. For example, electrochemical polishing may advantageously follow the present melting step prior to the deposition step in some cases. This will allow for removal of any oxides that may have formed on the substrate during the melting step, providing for improved adhesion and homogeneity of the deposited metal on the substrate in some cases. Various types of lasers can be used to achieve melting. While the $CC_2$ laser is typically employed in the CW mode, it can also be pulsed. Further improvements in $CO_2$ laser technology may allow for pulse durations of less than 5 microseconds, resulting in improved macroscopic smoothness, and less oxidation of the substrate, than is typical for the CW case. All such variations and deviations through which the present technique has advanced the art are considered to be within the spirit and scope of the invention.

We claim:

1. A method of making an electrical contact including the step of depositing a protective layer on at least a first portion of a metal substrate characterized by melting at least a second portion of the surface of said substrate with said first portion at least partially overlapping said second portion to a depth of less than 0.1 millimeters by means of an electron beam or laser beam prior to said deposition, wherein the duration of said melting at a given location on said substrate is less than 10 milliseconds, wherein said protective layer comprises at least one metal selected from the group consisting of gold, silver, platinum, ruthenium, rhodium, iridium, and palladium, and wherein said melting substantially reduces the average metallic grain diameter of said surface of said substrate.

2. The method of claim 1 further characterized in that the duration of said melting is less than 5 microseconds.

3. The method of claim 2 further characterized in that said melting is accomplished by means of a pulsed neodymium YAG laser.

4. The method of claim 3 further characterized in that the output of said laser is frequency doubled.

5. The method of claim 2 further characterized in that said electron beam or laser beam is pulsed to produce melted spots on said substrate which are partially overlapped, thereby producing a melted surface area larger than the area of each of said spots.

6. The method of claims 1, 2, 3, 4, or 5 further characterized in that said substrate comprises copper or nickel.

7. The method of claim 6 further characterized in that said protective layer is gold or a gold alloy.

8. The method of claim 8 further characterized in that said gold or gold alloy is deposited upon said substrate by electroplating.

9. The method of claims 1 or 2 further characterized in that the average metallic grain diameter of said surface of said substrate is greater than 50 nanometers prior to said melting, and less than 50 nanometers after said melting.

10. The method of claims 1 or 2 further characterized in that said depositing is accomplished by electrochemical deposition, or sputtering, or evaporating of said protective layer onto said substrate.

11. The method of claims 1 or 2 further characterized in that said substrate is a copper alloy comprising at least 80 weight percent copper, wherein said alloy has a thermal conductivity of less than 1 watt/cm-degree K. at just below the melting temperature of said alloy.

12. The method of claim 11 further characterized in that said melting is accomplished by means of a laser beam having a wavelength of less than 1.1 micrometers.

13. The method of claim 11 further characterized in that said melting is accomplished by means of a laser beam having a wavelength of less than 0.6 micrometers.

14. The method of claim 1 further characterized in that said substrate and said beam are translated relative to each other at a transverse velocity of at least 150 centimeters per second.

15. An electrical contact made according to the method of claim 1.

* * * * *